US008329066B2

(12) United States Patent
Kim et al.

(10) Patent No.: US 8,329,066 B2
(45) Date of Patent: Dec. 11, 2012

(54) PASTE CONTAINING ALUMINUM FOR PREPARING PDP ELECTRODE, METHOD OF PREPARING THE PDP ELECTRODE USING THE PASTE AND PDP ELECTRODE PREPARED USING THE METHOD

(75) Inventors: Chul-Hong Kim, Suwon-si (KR); Min-Jae Kim, Suwon-si (KR); So-Rae Chae, Suwon-si (KR); Eun-Gi Heo, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 299 days.

(21) Appl. No.: 12/464,804

(22) Filed: May 12, 2009

(65) Prior Publication Data

US 2010/0001640 A1 Jan. 7, 2010

Related U.S. Application Data

(60) Provisional application No. 61/078,722, filed on Jul. 7, 2008.

(51) Int. Cl.
*H01B 1/02* (2006.01)
*H01B 1/22* (2006.01)

(52) U.S. Cl. ..... 252/512; 252/500

(58) Field of Classification Search ..... 445/46, 445/24, 25; 313/311, 582–587; 252/512, 252/500
See application file for complete search history.

(56) References Cited

U.S. PATENT DOCUMENTS 6,075,319 A 6/2000 Kanda et al.
6,580,216 B1 6/2003 Lu et al.
2002/0096666 A1* 7/2002 Ichikawa et al. ..... 252/500
2003/0090204 A1 5/2003 Joo et al.
2004/0232840 A1 11/2004 Aoki et al.
2004/0251449 A1* 12/2004 Yonezawa et al. ..... 252/500
2006/0082308 A1 4/2006 Kawasaki
2006/0145623 A1 7/2006 Adachi et al.

(Continued)

FOREIGN PATENT DOCUMENTS

EP 1 780 747 A2 5/2007

(Continued)

OTHER PUBLICATIONS

European Search Report dated Aug. 3, 2010, for corresponding European Patent application 09251753.1.

(Continued)

*Primary Examiner* — Mariceli Santiago
*Assistant Examiner* — Glenn Zimmerman
(74) *Attorney, Agent, or Firm* — Christie, Parker & Hale, LLP

(57) ABSTRACT

Embodiments of the present invention provide a paste for forming a PDP electrode, a method of manufacturing a PDP electrode using the paste, and a PDP including the electrode. The paste includes an aluminum solution containing aluminum particles and a surface treatment agent. The aluminum particles have an average particle size of about 5 μm or less. The surface treatment agent is configured to withstand sintering temperatures of about 550° C. or greater, and remains on the surface of the aluminum particles after sintering. The electrode manufactured from the paste has a specific resistance of about 20 μΩ·cm or less, making it suitable for use as an electrode in a PDP having a reliability of 90% or greater.

8 Claims, 7 Drawing Sheets

U.S. PATENT DOCUMENTS

| | | | | |
|---|---|---|---|---|
| 2006/0164011 | A1* | 7/2006 | Lee et al. | 313/582 |
| 2006/0166113 | A1* | 7/2006 | Lee et al. | 430/7 |
| 2007/0079868 | A1 | 4/2007 | Rose et al. | |
| 2007/0092987 | A1* | 4/2007 | Kim | 438/82 |
| 2008/0067938 | A1 | 3/2008 | Kim et al. | |
| 2008/0261077 | A1* | 10/2008 | Park et al. | 428/702 |
| 2009/0295267 | A1 | 12/2009 | Park et al. | |
| 2010/0164357 | A1* | 7/2010 | Lee et al. | 313/311 |

FOREIGN PATENT DOCUMENTS

| | | | |
|---|---|---|---|
| EP | 1 887 601 | A1 | 2/2008 |
| JP | 6-77004 | | 3/1994 |
| JP | 10-273341 | | 10/1998 |
| JP | 2000-072479 | | 3/2000 |
| JP | 2003-151450 | | 5/2003 |
| JP | 2003-187709 | | 7/2003 |
| JP | 2005-139407 | | 6/2005 |
| JP | 2005-203359 | | 7/2005 |
| JP | 2006-011449 | | 1/2006 |
| JP | 2006-139989 | | 6/2006 |
| JP | 2007-100214 | | 4/2007 |
| JP | 2008-108719 | | 5/2008 |
| KR | 2000-0027527 | | 5/2000 |
| KR | 2000-0056857 | | 9/2000 |
| KR | 10-2007-0052170 | | 5/2007 |
| KR | 10-2007-0095497 | | 10/2007 |
| KR | 10-2007-0111195 | | 11/2007 |
| KR | 10-0781326 | B1 | 11/2007 |
| WO | WO 2006/129929 | A2 | 12/2006 |
| WO | WO 2008/010623 | A1 | 1/2008 |

OTHER PUBLICATIONS

European Search Report dated Aug. 2, 2010, for European Patent application 09251751.5.

KIPO Office action dated Apr. 20, 2011, for corresponding Korean Patent application 10-2009-0061717, noting listed references in this IDS.

KIPO Notice of Allowance for related Korean patent application No. 10-2009-0061716, dated Aug. 4, 2011, 5 pages.

Japanese Office action dated Oct. 4, 2011, for corresponding Japanese Patent application 2009-161119, noting listed references in this IDS, 2 pages.

Japanese Office action dated Dec. 20, 2011, for Japanese Patent application 2009-161120, 2 pages.

Patent Abstracts of Japan and English machine translation of Japanese Publication 2005-139407 listed above, 38 pages.

Patent Abstracts of Japan and English machine translation of Japanese Publication 10-273341 cited in PTO/SB/08A/B dated Nov. 3, 2011, 35 pages.

U.S. Office action dated Jan. 9, 2012, for cross reference U.S. Appl. No. 12/496,587, 23 pages.

Japanese Office action dated Jul. 31, 2012, for corresponding Japanese Patent application 2009-161119, (2 pages).

Patent Abstracts of Japan, and English machine translation of Japanese Publication 2006-139989 listed above (41 pages).

Patent Abstracts of Japan, and English machine translation of Japanese Publication 2008-108719 listed above (19 pages).

* cited by examiner

PASTE CONTAINING ALUMINUM FOR PREPARING PDP ELECTRODE, METHOD OF PREPARING THE PDP ELECTRODE USING THE PASTE AND PDP ELECTRODE PREPARED USING THE METHOD

CROSS-REFERENCE TO RELATED APPLICATION

This application claims priority to and the benefit of U.S. Provisional Application Ser. No. 61/078,722, filed Jul. 7, 2008, and titled "PASTE FOR PREPARING PDP ELECTRODE CONTAINING ALUMINUM, METHOD FOR PREPARING THE PDP ELECTRODE USING THE PASTE AND PDP ELECTRODE PREPARED USING THE METHOD," the entire content of which is incorporated herein by reference.

BACKGROUND OF THE INVENTION

1. Field of the Invention

The invention is directed to pastes for forming electrodes of a plasma display panel (PDP), methods of making electrodes using the paste, and PDPs including the electrodes. More particularly, the invention is directed to a paste for forming a PDP electrode including an aluminum solution containing aluminum particles and a surface treatment agent.

2. Description of the Related Art

Photolithography, due to its simple processing requirements, has arisen as the dominant method of making electrodes of plasma display panels. Photolithography is performed by printing and drying a paste composition to form a film with a desired thickness, irradiating light onto the film using an ultraviolet exposure device equipped with a photomask, selectively removing unexposed regions in a developing process, and then sintering the resulting film.

A conventional paste composition for forming PDP electrode includes an inorganic powder and a photosensitive organic component. The inorganic powder comprises a highly conductive metal such as gold, silver, nickel, copper, aluminum or the like. Aluminum has good anti-migration characteristics compared to silver (Ag), and the price of raw aluminum is relatively low, making aluminum a good material for electrodes. However, during sintering, aluminum oxidizes rapidly to produce hydrogen gas, and the accumulation of hydrogen gas can cause explosions. Consequently, aluminum is conventionally used only in thin film processes, such as sputtering methods, and is not appropriate for photolithography processes in which a paste is manufactured and sintering is necessary.

SUMMARY OF THE INVENTION

In one embodiment of the present invention, a paste for forming an electrode of a plasma display panel (PDP) includes an aluminum solution and glass frit. The aluminum solution includes aluminum particles and a surface treatment agent. The aluminum particles have an average particle size of about 5 μm or less. The surface treatment agent is configured to withstand sintering temperatures of about 550° C. or greater, and thus does not burn upon sintering. Rather, the surface treatment agent remains on the surface of the aluminum particles after sintering. Alternatively, the surface treatment may pyrolyze upon sintering, leaving its pyrolysis residue on the surface of the aluminum particles.

According to another embodiment of the present invention, a PDP electrode is made using the paste. The electrode comprises a sintered product of aluminum particles, a surface treatment agent and glass frit, and has a specific resistance of about 20 μΩ·cm or less.

In yet another embodiment of the present invention, a method of making a PDP electrode includes coating the paste on a substrate, drying the paste to form a conductive layer, patterning the conductive layer, and sintering the patterned conductive layer to form the electrode. The patterning can include exposing and developing the conductive layer, and the sintering can be performed under a reducing or oxidizing atmosphere.

The pastes according to embodiments of the present invention including aluminum particles enable the formation of electrodes having specific resistances of about 20 μΩ·cm or less. Previous aluminum-based electrodes were unable to achieve such a low specific resistance, hindering their use as PDP electrodes. By virtue of their low specific resistances, the aluminum-based electrodes according to embodiments of the present invention are suitable for use as PDP electrodes.

BRIEF DESCRIPTION OF THE DRAWINGS

The above and other features and advantages of the present invention will be better understood by reference to the following detailed description when considered in conjunction with the attached drawings in which.

DETAILED DESCRIPTION OF THE INVENTION

Figure 1:
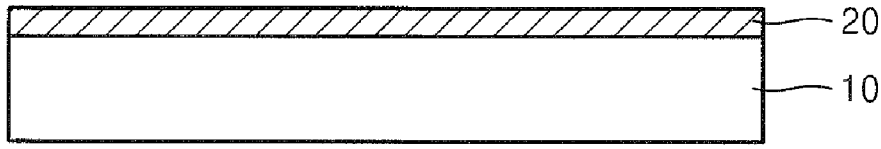
FIGS. 1 through 3 are cross-sectional views a PDP electrode, illustrating various steps in a method of forming the PDP electrode according to an embodiment of the present invention.

Since aluminum (Al) has excellent anti-migration characteristics compared to silver (Ag), and the price of raw aluminum is relatively low, aluminum is a good material for electrodes. However, during sintering, aluminum oxidizes rapidly to produce hydrogen gas, and the accumulation of hydrogen gas can cause explosions. To address this problem, the specific resistance of the aluminum has been increased. Consequently, aluminum is conventionally used only in thin film processes, such as sputtering methods, and is not appropriate for photolithography processes in which a paste is manufactured and sintering is necessary.

However, embodiments of the present invention provide a plasma display panel (PDP) electrode formed of aluminum having appropriate specific resistance. Oxidization of the aluminum is prevented by using a surface treatment agent that does not burn and remains during formation of the PDP electrode.

Embodiments of the present invention provide a paste for a PDP electrode comprising 60 to 68 parts by weight of an aluminum solution containing a surface treatment agent which does not burn at high temperatures of about 550° C. or greater, and aluminum particles. The paste also includes from about 2.5 to about 5.5 parts by weight of glass frit, and from about 15.5 to about 37.5 parts by weight of a vehicle.

The surface treatment agent does not burn at sintering or higher temperatures, but remains during formation of the PDP electrode by photolithography. When forming the PDP electrode, the paste for the PDP electrode is sintered at a temperature of about 550° C. or higher, and thus, according to embodiments of the present invention, the surface treatment agent does not burn at such temperatures, but remains. In one embodiment, the surface treatment agent does not volatilize during sintering, but remains on the surface of the aluminum particles. In an alternative embodiment, the surface treatment agent pyrolyzes during sintering, and residues of the pyrolyzed surface treatment agent remain on the surface of the aluminum particles.

The surface treatment agent may be a cellulose ether, which is an etherified hydroxyl of cellulose. Nonlimiting examples of suitable surface treatment agents include methylcellulose, ethylcellulose, hydroxyethylcellulose, benzylcellulose, tritylcellulose, cyanoethylcellulose, carboxymethylcellulose, carboxyethylcellulose, aminoethylcellulose, etc., and derivatives thereof that do not burn at temperatures of about 550° C. or higher. Ethylcellulose has good characteristics, and derivatives thereof may be used.

The amount of the surface treatment agent may range from about 3 to about 34 parts by weight based on 100 parts by weight of the paste. If the amount of the surface treatment agent is less than about 3 parts by weight, manufacturing the paste for a PDP electrode becomes difficult. If the amount of the surface treatment agent is greater than about 34 parts by weight, hydrogen may be generated, giving rise to a danger of explosion due to the interaction between the aluminum particles, and aluminum may be oxidized during sintering when manufacturing the PDP electrode.

The larger the aluminum particles, the smaller their specific resistance. Thus, regarding the specific resistance, aluminum particles having a large particle size may be used. However, when the aluminum particles are large, the surface of the PDP electrode formed from the large aluminum particles becomes porous. Accordingly, leakage can occur by discharge gas flowing into the pores of the surface of the PDP electrode. Thus, the aluminum solution according to embodiments of the present invention may include aluminum particles having an average particle size of about 5 μm or less.

Compared to the surface roughness of conventional PDP electrodes formed by photolithography using a paste containing Ag, the aluminum particles of the aluminum solution according to embodiments of the present invention may have an average particle size of about 5 μm or less in order to have similar surface characteristics to that of conventional PDP electrodes. When the average particle size of the aluminum particles exceeds 5 μm, the surface of the PDP electrode becomes porous and leakage may occur. That the average particle size of the aluminum particles is about 5 μm or less according to embodiments of the present invention means that the particle size of a large quantity of aluminum particles is about 5 μm or less, i.e., the particle size of most of the aluminum particles is about 5 μm or less, so as to substantially prevent leakage. Also, the aluminum particles are not limited to having a particle size of about 5 μm or less, and this does not mean that the simple average particle size of all the aluminum particles is 5 μm or less. That is, aluminum particles having an average particle size exceeding about 5 μm may be included in small quantities, and embodiments of the present invention can include a small quantity of aluminum particles having an average particle size exceeding about 5 μm so long as leakage is substantially prevented.

The amount of the aluminum particles may range from about 18 to 40.8 parts by weight based on 100 parts by weight of the paste. When the amount of the aluminum particles is less than about 18 parts by weight, openings may be formed in the PDP electrode. When the amount of the aluminum particles is greater than about 40.8 parts by weight, the desired patterns are difficult to obtain due to an insufficient cross-linking reaction caused by the decrease in light transmission.

The aluminum solution may further include a dispersant and a solvent. The dispersant increases the dispersion stability of the aluminum particles, and prevents condensation or precipitation of the aluminum particles. Nonlimiting examples of suitable dispersants include polymer compounds or compounds including functional groups having a polar affinity, such as carboxyl groups, hydroxyl groups and acid ester groups, etc. The solvent is used to manufacture the aluminum solution and may be an organic or inorganic solvent typically used in the field. Nonlimiting examples of suitable solvents include ketones, alcohols, ether-based alcohols, saturated aliphatic monocarboxylic acid alkyl esters, lactic acid esters, ether-based esters, and combinations of thereof, etc.

Also, the aluminum solution may further include additives such as antioxidants, optical stabilizers, ultraviolet ray absorbents, lubricants, pigments, flame retardants, etc. While the PDP is being sintered, the additive may be contained in an amount of about 5 parts by weight so long as the surface treatment agent or decomposition product thereof remains on the aluminum particles and are arranged on the surface of the aluminum particles, particularly on the surface of the PDP electrode which is exposed to the outside during sintering.

The amount of the dispersant, the solvent, or the additive may make up the remainder of the aluminum solution after accounting for the aluminum particles and the surface treatment agent.

The aluminum solution is present in the paste in an amount ranging from about 60 to about 68 parts by weight. If the aluminum solution is present in an amount less than about 60 parts by weight, openings may be formed in the PDP electrode. If the aluminum solution is present in an amount greater than about 68 parts by weight, hydrogen may be generated due to the interaction between aluminum particles, giving rise to a danger of explosion.

Glass frit helps necking between the aluminum particles when forming the PDP electrode, and can increase adhesion of the aluminum particles to the PDP substrate or another PDP electrode. The glass frit may contain lead (Pb), boron (B), silicon (Si), bismuth (Bi), phosphor (P), lithium (Li), zinc (Zn), barium (Ba), tin (Sn), etc. For example, the glass frit may be a mixture of at least two metal oxides, such as $Bi_2O_3$—$B_2O_3$ based compounds, $Bi_2O_3$—$B_2O_3$—ZnO based compounds, $P_2O_5$—SnO—ZnO based compounds, and $B_2O_3$—SnO—BaO based compounds. As used herein, "$Bi_2O_3$—$B_2O_3$ based compounds" and similar terms refer to compounds having at least the named components (e.g. $Bi_2O_3$ and $B_2O_3$), but that can include other components (e.g. oxides). For example, a $Bi_2O_3$—$B_2O_3$ based compound may include $Bi_2O_3$ and $B_2O_3$ in addition to other oxides. The glass frit is in the form of powder.

The amount of the glass frit ranges from about 2.5 to 5.5 parts by weight. When the amount of the glass frit is less than about 2.5 parts by weight, the liquid material for necking between the aluminum particles is insufficient, thereby increasing resistance and decreasing adhesion of the PDP electrode. When the amount of the glass frit is greater than about 5.5 parts by weight, the aluminum particles may neck together, forming agglomerated aluminum particles. Accordingly, the resistance of the PDP electrode increases.

In order to form a PDP electrode by photolithography, the vehicle contains a photo initiator, a cross-linking agent, and a binder. The photo initiator may be any compound that generates a radical during photographing, and initiates a cross-linking reaction of the cross-linking agent. Nonlimiting examples of suitable photo initiators include benzophenone, 4,4-bis(dimethylamino)benzophenone, 4,4-bis(diethylamino)benzophenone, 2,2-diethoxyacetophenone, 2,2-dimethoxy-2-phenyl-2-phenylacetophenone, 2-methyl-[4-(methylthio)phenyl]-2-morpholinopropan-1-one, 2-benzyl-2-dimethylamino-1-(4-morpholinophenyl)-1-butanone, bis(2,6-dimethoxybenzoyl)-2,4,4-trimethyl pentylphosphine oxide, and bis(2,4,6-trimethylbenzoyl)phenylphosphine oxide, and combinations thereof.

The amount of the photo initiator may range from about 0.01 to about 4.5 parts by weight based on 100 parts by weight of the vehicle. When the amount of the photo initiator is less than about 0.01 parts by weight based on 100 parts by weight of the vehicle, the exposure sensitivity of the paste for the PDP electrode is decreased. When the amount of the photo initiator is greater than about 4.5 parts by weight based on 100 parts by weight of the vehicle, the line width of exposed regions of the conductive layer is small, unexposed regions of the conductive layer may not be developed, and clear electrode patterns are difficult to obtain.

The cross-linking agent may be any compound that can be radically polymerized by the photo initiator. For example, the cross-linking agent may be a mono-functional or multi-functional monomer. In one embodiment, in order to increase exposure sensitivity, the cross-linking agent may be a multifunctional monomer. Nonlimiting examples of suitable multifunctional monomers include diacrylates (such as ethyleneglycol diacrylate (EGDA)), triacrylates (such as trimethylolpropane triacrylate (TMPTA), trimethylolpropane ethoxylate triacrylate (TMPEOTA), and pentaerythritol triacrylate), tetraacrylates (such as tetramethylolpropanetetracrylate, and pentaerythritol tetraacrylate), and hexacrylates (such as dipentaerythritol hexacrylate (DPHA)), and combinations thereof.

The amount of the cross-linking agent may range from about 0.01 to about 2.0 parts by weight based on 100 parts by weight of the vehicle. When the amount of the cross-linking agent is less than about 0.01 part by weight based on 100 parts by weight of the vehicle, exposure sensitivity is decreased during exposure, and defects may be generated in the PDP electrode patterns during developing. On the other hand, when the amount of the cross-linking agent exceeds about 2.0 parts by weight based on 100 parts by weight of the vehicle, the line width of the conductive layer becomes large after development, and thus the patterns of the PDP electrode are unclear and residues may be generated around the PDP electrode after sintering.

When coating a substrate with the paste for a PDP electrode according to embodiments of the present invention, the binder exhibits appropriate viscosity, thereby increasing printing characteristics. Also, the binder can improve necking characteristics of the aluminum particles and promote adhesion between the aluminum particles and the PDP substrate. The binder may be a polymer which can be cross-linked by the photo initiator and which can be easily removed during development. Nonlimiting examples of suitable binders include acrylic resins, styrene resins, novolac resins, polyester resins, and combinations thereof. More specifically, some nonlimiting examples of suitable binders include monomers containing a carboxyl group, monomers containing a hydroxyl group, and polymerizable monomers. Nonlimiting examples of monomers containing a carboxyl group include acetates, methacetates, fumaric acid, crotonic acid, itaconic acid, citraconic acid, mesaconic acid, cinnamic acid, succinic acid mono(2-(meth)acryloyloxyethyl), and ω-carboxy-polycaprolactonemono(meth)acrylate. Nonlimiting examples of monomers containing a hydroxyl group include hydroxyl group-containing monomers (such as (meth)acetate-2-hydroxyethyl, (meth)acetate-2-hydroxypropyl, and (meth)acetate-3-hydroxypropyl), and phenolic hydroxyl group-containing monomers (such as o-hydroxystyrene, m-hydroxystyrene, and p-hydroxystyrene). Nonlimiting examples of polymerizable monomers include (meth)acetate esters (such as (meth)acetatemethyl, (meth)acetateethyl, (meth)acetate n-butyl, (meth)acetate n-lauryl, (meth)acetate benzyl, glycidyl(meth)acrylate, dicyclopentanyl(meth)acrylate, etc.), aromatic vinyl monomers (such as styrene, α-methyl styrene, etc.), conjugated dienes such as butadiene, isoprene, etc.), macromonomers having a polymerization unsaturated group such as a (meth)acryloyl group at an end of the polymerization chain (such as polystyrene, poly(meth)acetatemethyl, poly(meth)acetateethyl, poly(meth)acetate benzyl, etc.).

The amount of the binder may range from about 0.05 to about 5.0 parts by weight based on 100 parts by weight of the vehicle. When the amount of the binder is less than about 0.05 parts by weight based on 100 parts by weight of the vehicle, adhesion of the paste to the PDP substrate or another PDP electrode may be weakened. When the amount of the binder is greater than about 5.0 parts by weight based on 100 parts by weight of the vehicle, the conductive layer prepared by the paste may be poorly developed.

Also, a solvent, and other additives for various purposes may be further included in the vehicle. The solvent may be an organic or inorganic solvent that is generally used in the field. Nonlimiting examples of the solvent include ketones, alcohols, ether alcohols, alkyl esters of saturated aliphatic monocarboxylic acids, lactic acid esters, ether esters, and combinations thereof. Nonlimiting examples of additives include dispersants for dispersing aluminum particles, sensitizers for increasing sensitivity, polymerization prohibitors, anti-oxidants for increasing conservability of the composition for forming the PDP electrode, ultraviolet ray absorbents for increasing resolution, anti-foaming agents for reducing bubbles in the paste, dispersants for increasing dispersibility, leveling agents for increasing planarization properties of layers during printing, plasticizers for providing thixotropic properties, etc. These additives are not essential but may be used according to specific requirements, and the amount of the additives may be adjusted as desired and may be within generally known amounts.

The amount of the vehicle may range from about 15.5 to 37.5 parts by weight. When the amount of the vehicle is less than about 15.5 parts by weight, the vehicle affects the viscosity of the paste, and thus printing characteristics become poor and exposure sensitivity is decreased. When the amount of the vehicle is greater than about 37.5 parts by weight, the content ratio of the aluminum particles is reduced, and thus the contraction of the conductive layer during sintering becomes severe, and openings may be generated in the conductive layer.

Figure 2:
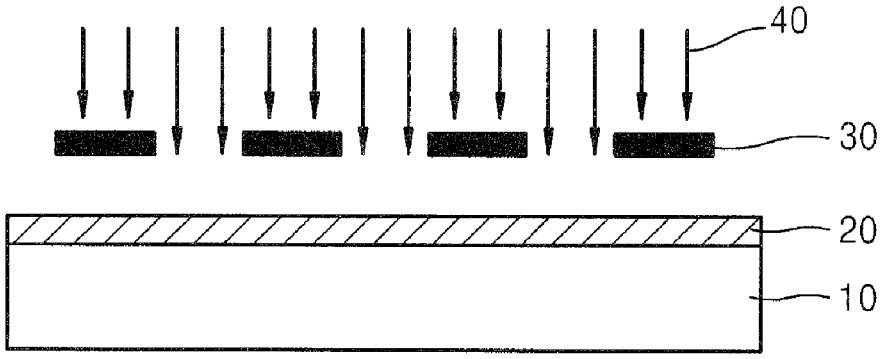
Figure 3:
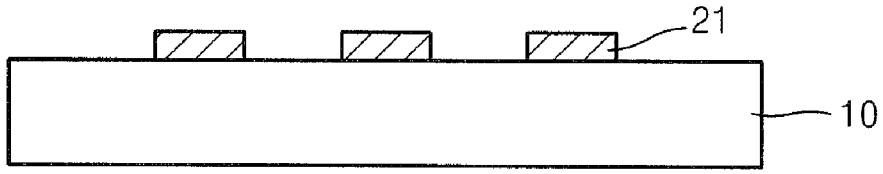

Embodiments of the present invention provide a method of forming a PDP electrode using the paste according to the above embodiments. The method will be described with reference to FIGS. 1 through 3. FIGS. 1 through 3 are cross-sectional views of a PDP electrode, illustrating various stages in a method according to an embodiment of the present invention. Referring to FIG. 1, a PDP substrate 10 is provided, and is coated with the above-described paste for a PDP electrode and dried to form a conductive layer 20. The paste may be printed on the PDP substrate 10 using a screen printing method. After printing, the PDP substrate 10 is heated and dried for 5 to 30 minutes at a temperature ranging from about 50 to about 130° C.

Referring to FIG. 2, a photo mask 30 having patterns is disposed at a distance to face the PDP substrate 10 on which the conductive layer 20 is formed, and a binder and cross-linking agent are hardened using a photo initiator by selectively irradiating (exposing) light through the photo mask 30. The exposure is performed by irradiating light such as visible light, ultra violet rays, far infrared rays, electronic rays, or X-rays, etc. using a typical exposure apparatus.

Although a positive exposure process is described, the present invention is not limited thereto, and a negative exposure process may also be performed according to the type of the photo initiator, binder, and cross-linking agent.

Referring to FIG. 3, exposed regions of the conductive layer 20 are removed by developing the conductive layer 20 using a developing solution (such as an alkaline solution) after the exposure process, thereby forming a PDP electrode 21 having patterns.

The alkaline solution may be an aqueous solution including a base. For example the solution may be an inorganic alkaline solution including a base. Nonlimiting examples of suitable bases include lithium hydroxide, sodium hydroxide, potassium hydroxide, sodium hydrogen phosphate, diammonium hydrogen phosphate, dipotassium hydrogen phosphate, disodium hydrogen phosphate, ammonium dihydrogen phosphate, potassium dihydrogen phosphate, sodium dihydrogen phosphate, lithium silicate, sodium silicate, potassium silicate, lithium carbonate, sodium carbonate, potassium carbonate, lithium borate, sodium borate, potassium borate, and organic alkali compounds (such as ammonia, tetramethyl ammonium hydroxide, trimethylhydroxyethyl ammonium hydroxide, monomethyl amine, dimethyl amine, trimethyl amine, monoethyl amine, diethyl amine, triethyl amine, monoisopropyl amine, diisopropyl amine, ethanolamine, etc.).

The conditions of the developing process may be those typically used in the field. For example, the type and density of the developing solution, the developing time, the developing temperature, developing methods (such as dipping, shaking, showering, spraying, paddling, etc.), and developing apparatus may be selected as desired. Also, after the developing process, a washing process is usually performed, and unnecessary residuals on the sides of the PDP electrode 21 and exposed portions of the PDP substrate 10 may be removed after the developing process.

Then, the PDP electrode 21 having patterns is sintered for from about 10 minutes to about 3 hours at a temperature ranging from about 550 to about 650° C. This sintering process may also be performed in a reducing or oxidizing atmosphere.

The above-described method of forming a PDP electrode according to an embodiment of the present invention may be used to form not only an address electrode (to which a voltage is applied to generate an address discharge while facing a Y electrode when driving a PDP), but also to form an X electrode or a Y electrode (which generate sustaining discharge as a voltage is alternately applied thereto).

Also, the present invention provides a PDP electrode manufactured according to the above-described method of forming a PDP electrode.

The PDP electrode includes aluminum, wherein the surface treatment agent remains on the surface of the aluminum particles, and glass frit. A specific resistance of the PDP electrode is about 20 μΩ·cm or less.

As the aluminum particles are necked to one another by sintering the above-described paste, a conductive PDP electrode can be formed. The paste for a PDP electrode prevents oxidization of the aluminum particles despite the sintering process, and thus a PDP electrode having a specific resistance of about 20 μΩ·cm or less can be manufactured. Oxidization of the aluminum particles can also be prevented using the surface treatment agent which remains after sintering. The lower the specific resistance of the PDP electrode, the higher the conductivity of the PDP electrode. In embodiments of the present invention, the PDP electrode has a specific resistance of about 20 μΩ·cm or less, whereas conventional aluminum electrodes have specific resistances of 100 μΩ·cm or greater. The minimum specific resistance required for a PDP electrode is about 20 μΩ·cm, in order to impart reliability of 90% or greater.

Also, since the PDP electrode is formed by photolithography, a vehicle including a photoinitiator, a cross-linking agent, and a binder is included.

According to another embodiment of the present invention, a PDP is provided. The PDP may include an address electrode formed using the above-described paste, which includes an aluminum solution (including aluminum particles and a surface treatment agent configured to withstand sintering temperatures of about 550° C. or greater) and glass frit. Though the paste is described as being used to form the address electrode, it is understood that the paste may also be used to form any electrode of the PDP, including the X and/or Y electrodes.

Figure 12:
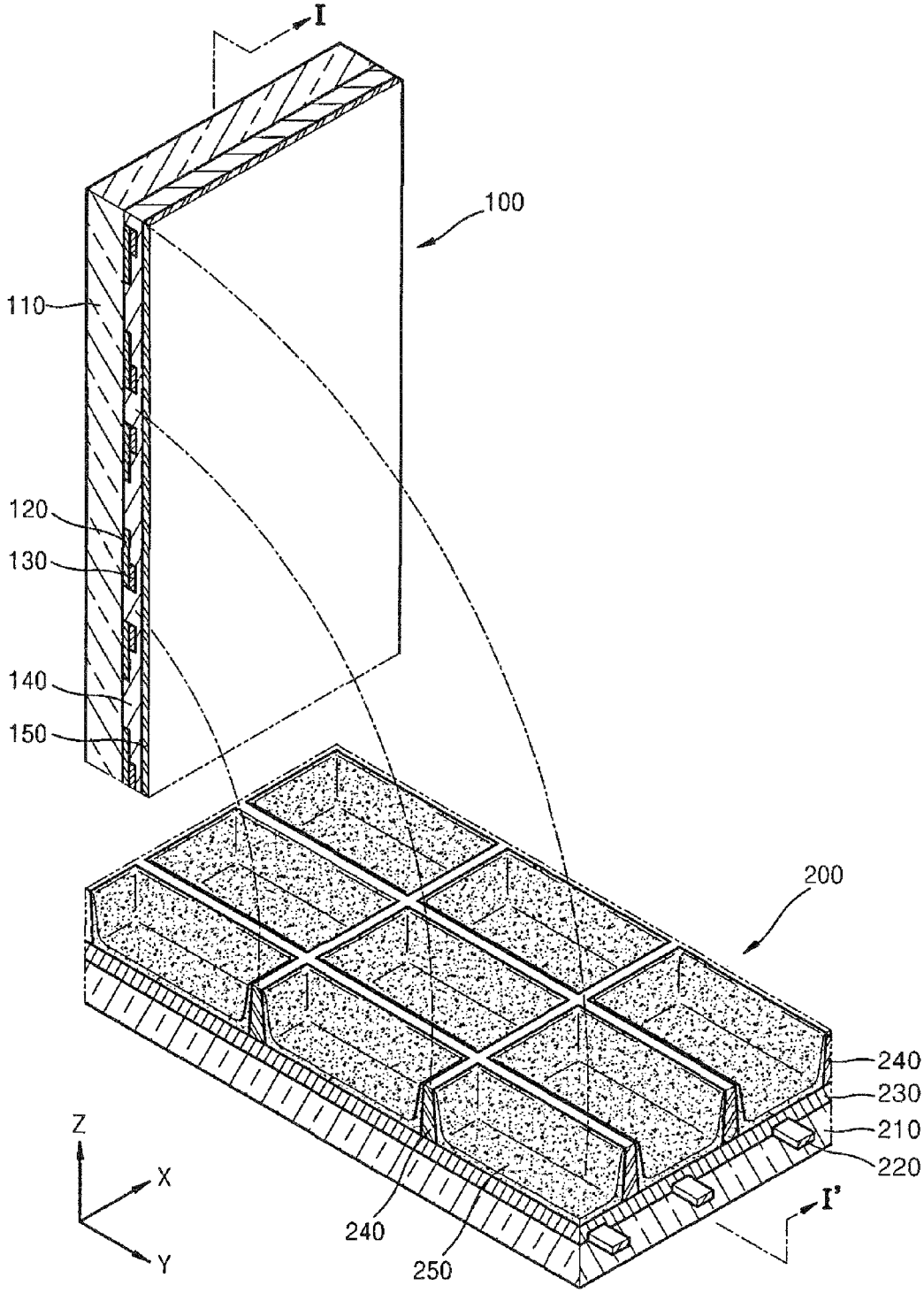
FIG. 12 is an exploded perspective view of a PDP according to an embodiment of the present invention.

Referring to FIG. 12, the PDP includes a top panel 100 through which light is emitted to the outside, and a bottom panel 200 that includes a phosphor for emitting light. On the top panel 100, a plurality of transparent electrodes 120 extend along a top glass substrate 110 in an X direction, and a bus electrode 130 is disposed on each transparent electrode 120 such that the bus electrode 130 is substantially parallel to the transparent electrode 120. The transparent electrodes 120 and bus electrodes 130 are covered by a top dielectric layer 140 and protective layer 150 which are sequentially disposed on the top glass substrate 110. The top dielectric layer 140 protects the bus electrodes 130 and the transparent electrodes 120 from direct collusion with charge particles involved in discharging. The protective layer 150 protects the top dielectric layer 140. The protective layer 150 can induce emission of secondary electrons to activate the discharge.

On the bottom panel 200, a plurality of address electrodes 220 extend along a bottom glass substrate 210 in a Y direction. The address electrodes 220 comprise sintered products of aluminum particles, a surface treatment agent, and glass frit, and the address electrodes 220 have a specific resistance of about 20 μΩ·cm or less. As used herein, "specific resistance" is a measure of resistance per unit area and unit volume of the electrode formed by sintering. The address electrode 220 can be formed using the above-described paste.

The address electrodes 220 are covered by a bottom dielectric layer 230, and barrier ribs 240 define a plurality of discharge cells on the bottom dielectric layer. A phosphorescent layer 250 is disposed in each discharge cell. Specifically, the phosphorescent layer 250 is disposed on the sidewalls of the barrier ribs 240 and on the dielectric layer 230. The phosphorescent layers 250 disposed in the discharge cells may be different from each other. For example, the phosphorescent layer 250 may be a red, green or blue phosphorescent layer.

Figure 13:
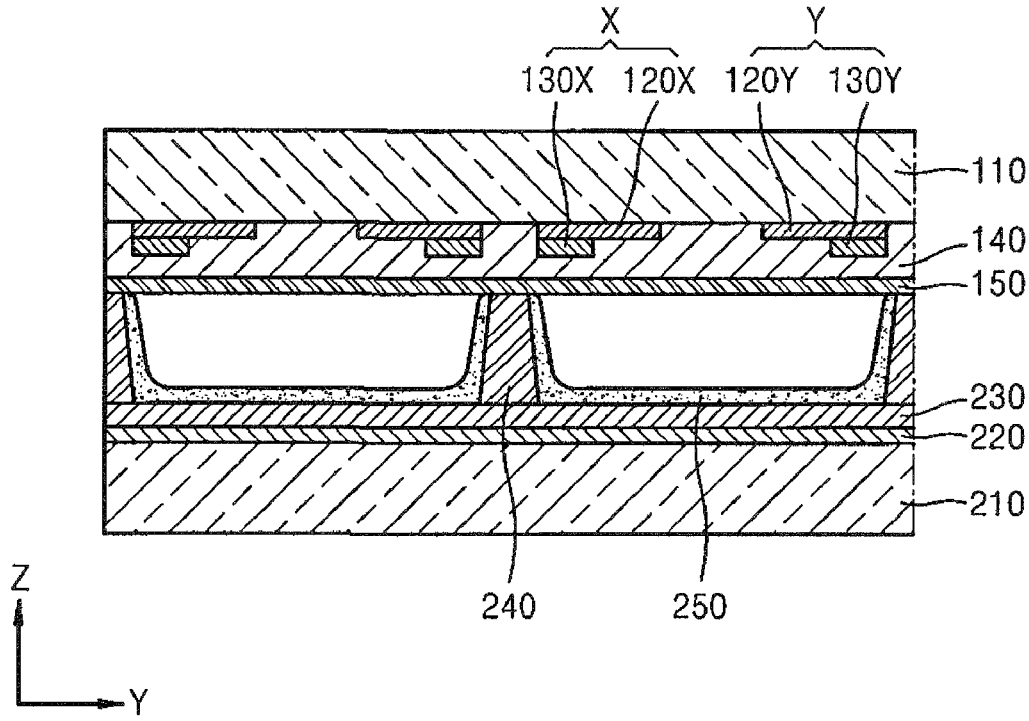
FIG. 13 is a cross-sectional view taken along line I-I of the PDP of FIG. 12.

Referring to FIG. 13, each discharge cell independently emits light because the discharge cell is separated from neighboring discharge cells by the barrier rib 240. Specifically, each discharge cell includes a pair of sustain electrodes X and Y, and an address electrode 220 intersecting the pair of sustain electrodes X and Y. The pair of sustain electrodes X and Y includes an X electrode and a Y electrode. The X electrode includes an X transparent electrode 120X and an X bus electrode 130X, and the Y electrode includes a Y transparent electrode 120Y and a Y bus electrode 130Y. A voltage is alternatively applied to the pair of sustain electrodes X and Y and causes display discharging, and before display discharging occurs, an address discharge occurs between the Y electrode and the address electrode 220. The address discharge is a pretreatment discharge by which priming particles are accumulated in a discharge cell to be displayed so as to cause a display discharge to emit light toward the outside.

Hereinafter, examples of manufacturing a paste for a PDP electrode, and a PDP electrode prepared using the paste by photolithography according to embodiments of the present invention will be described. Also, results from the evaluation of the specific resistance and surface porosity of the PDP electrodes according to the examples will be described. However, the following examples are presented for illustrative purposes only, and do not limit the scope of the present invention.

Example 1

Manufacture of a PDP Address Electrode Including Aluminum Particles Having an Average Particle Size of 7 μm 1000 g of an aluminum solution was prepared using 600 g of aluminum powder, 50 g of ethylcellulose (EC) and 350 g of ethyl alcohol. The aluminum powder contained aluminum particles having an average particle size of 7 μm. The ethanol contained 0.4 μl of dispersant Disperbyk-190 (from BYK).

Then, 1000 g of the aluminum solution, 50 g of glass frit, 3.5 g of a photoinitiator, 3.5 g of a cross-linking agent, and 16.5 g of a binder were added to 326.5 ml of ethyl alcohol and agitated. A mixture of $SiO_2$, PbO, $Bi_2O_3$, ZnO, and BaO was used as the glass frit. 2,2-dimethoxy-2-phenyl-2-phenyl acetophenone was used as the photoinitiator. Tetramethylolpropane tetraacrylate was used as the cross-linking agent. Also, a mixture of methyl methacrylate/methacrylate (MMA/MAA) copolymer, hydroxypropyl cellulose (HPC), ethylcellulose (EC), and poly(isobutyl methacrylate) (PIBMA) was used as the binder.

Then, agitation and dispersion were further performed in an agitator, and then filtering and degassing processes were performed to manufacture a paste for a PDP electrode.

A glass substrate (10 cm×10 cm) prepared in advance was washed and dried, and coated with the paste for the PDP electrode using a screen printing method. Then the glass substrate was dried in a drying oven at 100° C. for 15 minutes to form a conductive layer. A photo mask having a striped pattern was disposed at a distance above the conductive layer, and then ultraviolet rays of 450 mJ/cm$^2$ were irradiated using a high pressure quicksilver lamp to expose the conductive layer to light. Then a 0.4 weight % sodium carbonate solution at 35° C. was sprayed for 25 seconds at a spraying pressure of 1.5 kgf cm to develop the conductive layer, and the unexposed regions of the conductive layer were removed to form a PDP electrode pattern.

Then, the PDP electrode pattern was sintered using an electric sintering furnace at 580° C. for 15 minutes to manufacture a patterned address electrode having a layer thickness of about 12 μm.

Example 2

Manufacture of a PDP Address Electrode Including Aluminum Particles Having an Average Particle Size of 5 μm A PDP address electrode was manufactured as in Example 1 except that 600 g of aluminum powder with particles having an average particle size of 5 μm was used. The thickness of the address electrode obtained was about 9 μm.

Example 3

Manufacture of a PDP Address Electrode Including Aluminum Particles Having an Average Particle Size of 3 μm A PDP address electrode was manufactured as in Example 1 except that 600 g of aluminum powder with particles having an average particle size of 3 μm was used. The thickness of the address electrode obtained was about 8 μm.

Comparative Example

Manufacture of an Address Electrode Including Ag Powder

A PDP address electrode was manufactured as in Example 1 except that Ag powder was used instead of the aluminum solution.

Evaluation Example 1

Evaluation of the Specific Resistance of Electrodes

The specific resistance of each of the PDP address electrodes of Examples 1 to 3 was measured in Evaluation Example 1. The specific resistance was measured using a 4-point probe resistance measuring apparatus.

Table 1 shows the results of the evaluation of specific resistance. As can be seen from Table 1, the PDP electrodes of Examples 1 to 3 according to the present invention have a specific resistance of about 20 μΩ·cm or less, which is required for use as a PDP electrode in order to achieve a product having a reliability of 90% or greater.

TABLE 1

| Type | Specific resistance (μΩ · cm) |
|---|---|
| Example 1 | 13.5 |
| Example 2 | 16.7 |
| Example 3 | 20.2 |

Evaluation Example 2

Evaluation of Surface Porosity of the Electrodes

Figure 4:
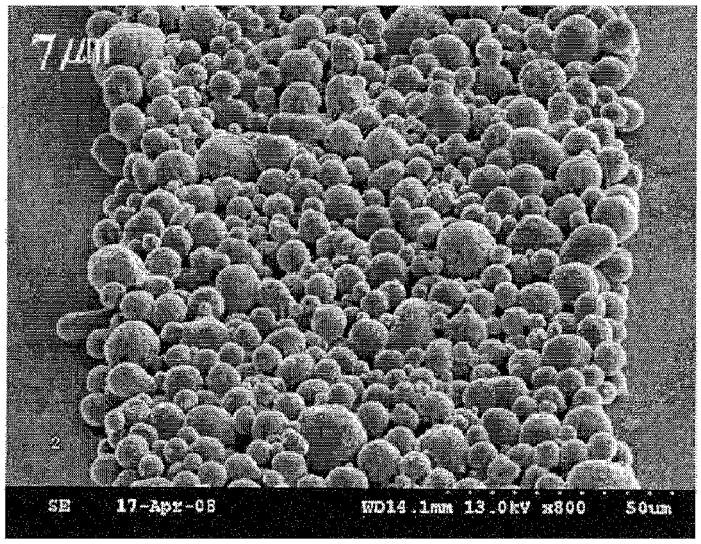
FIGS. 4 and 5 are photographs of a surface of a PDP electrode containing aluminum particles having an average particle size of 7 μm.
Figure 5:
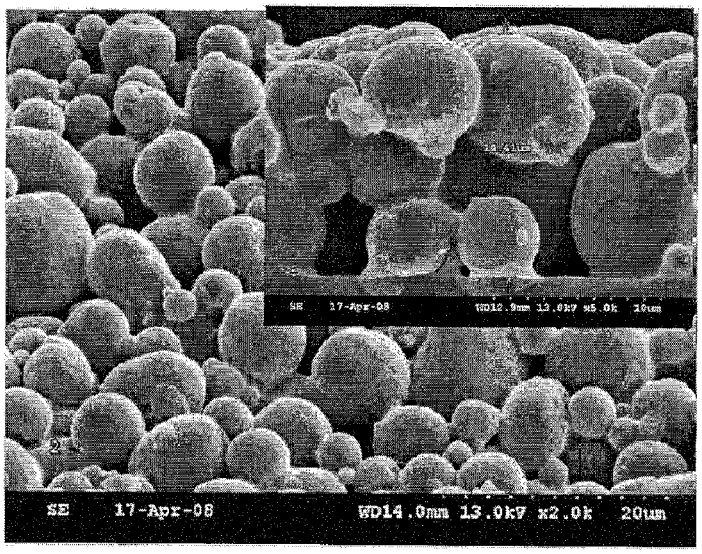
Figure 6:
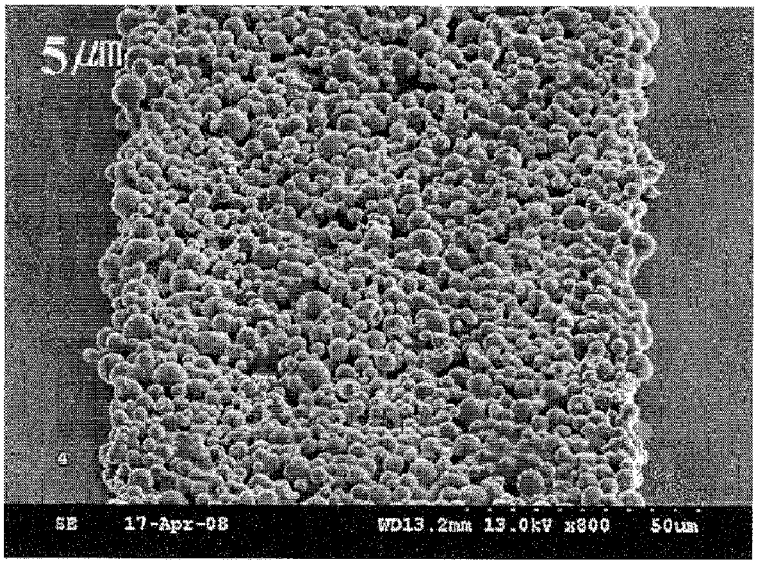
FIGS. 6 and 7 are photographs of a surface of a PDP electrode containing aluminum particles having an average particle size of 5 μm.
Figure 7:
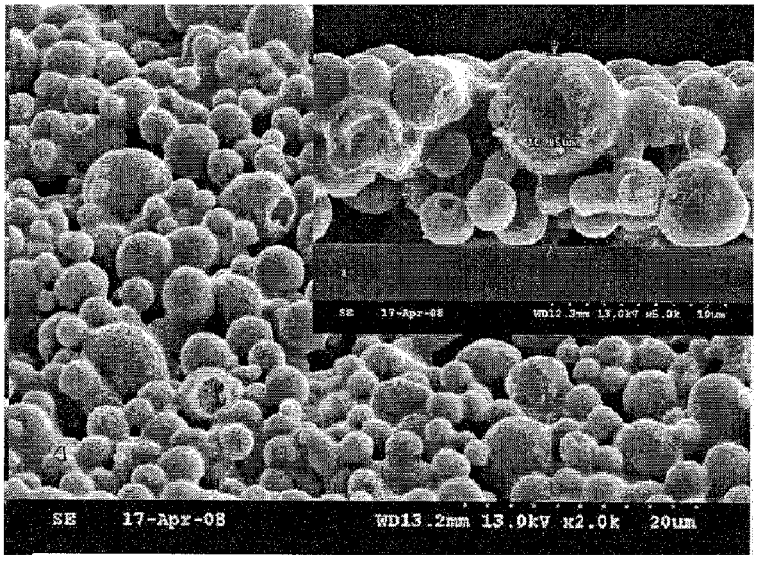
Figure 8:
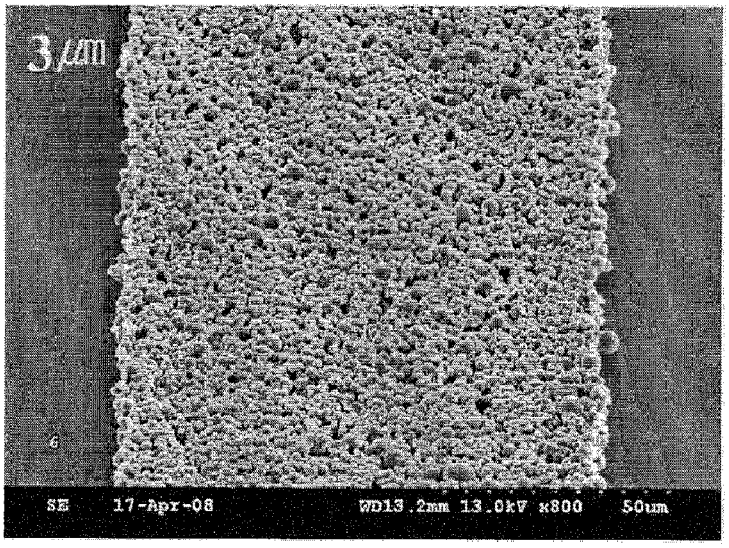
FIGS. 8 and 9 are photographs of a surface of a PDP electrode containing aluminum particles having an average particle size of 3 μm.
Figure 9:
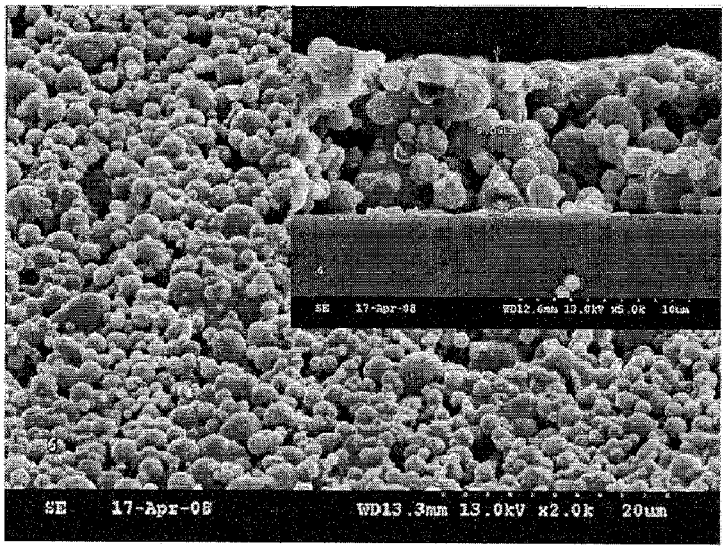
Figure 10:
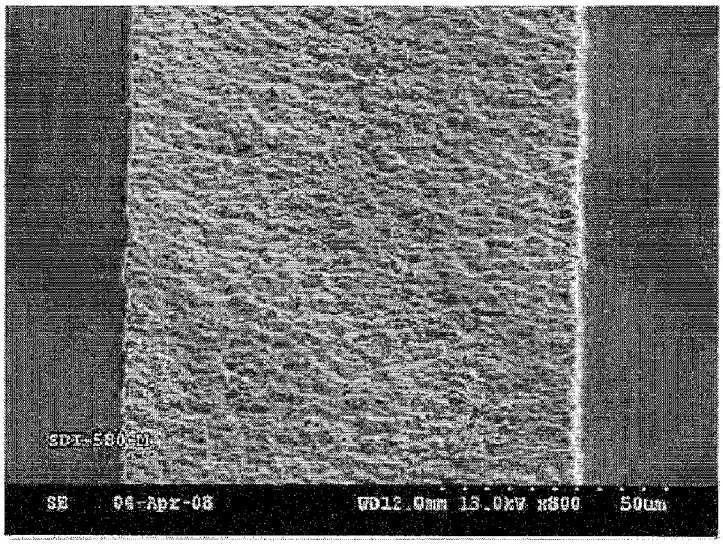
FIGS. 10 and 11 are photographs of a surface of a PDP electrode containing silver.
Figure 11:
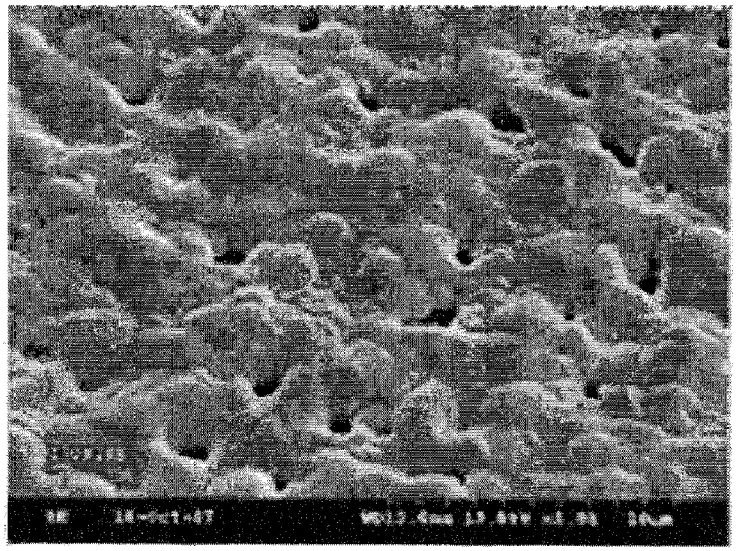

In Evaluation Example 2, scanning electronic microscope (SEM) photographic images were taken to observe minute patterns of the PDP address electrodes of Examples 1 to 3. FIG. 4 is an image of the surface of the PDP address electrode of Example 1, and FIG. 5 is a close-up image of the electrode of FIG. 4. FIG. 6 is an image of the surface of the PDP address electrode of Example 2, and FIG. 7 is a close-up image of the electrode of FIG. 6. FIGS. 8 and 9 are photographic images of the PDP address electrode of Example 3. FIG. 9 is a close-up image of the electrode of FIG. 6. FIG. 10 is an image of the surface of the PDP address electrode of the Comparative Example, and FIG. 11 is a close-up image of the electrode of FIG. 10.

Compared to the surfaces of PDP address electrodes of a control group having reliabilities of 90% or more, the PDP address electrodes of Examples 2 and 3 had similar surface roughnesses. That is, the porosity of the surface of the PDP address electrodes of Examples 2 and 3 is the same as or greater than that of the control group, which is attributed to the small size of the aluminum particles. However, the surface of the PDP address electrode of Example 1 is considerably more porous than the control group, and thus leakage from the flow of discharge gas to the surface of the PDP address electrode may occur. Accordingly, in embodiments of the present invention, the aluminum particles have an average particle size of about 5 μm or less.

As described above, embodiments of the present invention provide a paste for a PDP electrode including an aluminum solution containing a surface treatment agent and aluminum particles. Other embodiments of the present invention provide a method of forming a PDP electrode using the paste. Yet other embodiments of the present invention provide a PDP electrode manufactured using the method.

In detail, the surface treatment agent in the aluminum solution does not burn during sintering, and the surface treatment agent itself or its decomposition products remain on the surface of the aluminum particles, thereby preventing the oxidization of aluminum. Accordingly, a PDP electrode can be manufactured by photolithography (which uses relatively inexpensive manufacturing equipment) to have a specific resistance of about 20 μΩ·cm or less, which is required to manufacture a PDP having a reliability of about 90% or greater.

Also, as the aluminum particles have an average particle size of about 5 μm or less, the surface of the PDP electrode is not porous, thus preventing leakage from the flow of discharge gas to the surface of the PDP electrode.

While the present invention has been illustrated and described with reference to certain exemplary embodiments, it is understood by those of ordinary skill in the art that various modifications and changes may be made to the described embodiments without departing from the spirit and scope of the present invention as defined by the following claims.

What is claimed is:

1. A paste for forming an electrode of a plasma display panel, the paste comprising:

an aluminum solution comprising aluminum particles and a surface treatment agent, the aluminum particles being present in the paste in an amount ranging from about 18 to about 40.8 parts by weight based on 100 parts by weight of the paste, the surface treatment agent being selected from the group consisting of methylcellulose, benzylcellulose, tritylcellulose, cyanoethylcellulose, carboxymethylcellulose, carboxyethylcellulose, aminoethylcellulose, and derivatives thereof;

glass frit; and a vehicle present in an amount ranging from about 15.5 to about 37.5 parts by weight based on 100 parts by weight of the paste, the vehicle comprising a photoinitiator, a cross-linking agent, and a binder, the photoinitiator being present in the vehicle in an amount ranging from about 0.01 to about 4.5 parts by weight based on 100 parts by weight of the vehicle, the cross-linking agent being present in the vehicle in an amount ranging from about 0.01 to about 2 parts by weight based on 100 parts by weight of the vehicle, and the binder being present in the vehicle in an amount ranging from about 0.05 to about 5 parts by weight based on 100 parts by weight of the vehicle.

2. The paste of claim 1, wherein the surface treatment agent is configured to withstand sintering temperatures of about 550° C. or higher.

3. The paste of claim 1, wherein the solution is present in an amount ranging from about 60 to about 68 parts by weight based on 100 parts by weight of the paste, the glass fit is present in an amount ranging from about 2.5 to about 5.5 parts by weight based on 100 parts by weight of the paste.

4. The paste of claim 1, wherein the surface treatment agent is present in the paste in an amount ranging from about 3 to about 34 parts by weight based on 100 parts by weight of the paste.

5. The paste of claim 1, wherein the solution further comprises a solvent and a dispersant.

6. The paste of claim 1, wherein the solution further comprises an additive selected from the group consisting of antioxidants, optical stabilizers, ultraviolet ray absorbents, lubricants, pigments, flame retardants, and combinations thereof.

7. The paste of claim 6, wherein the additive is present in the solution in an amount of about 5 parts by weight based on 100 parts by weight of the solution.

8. The paste of claim 1, wherein the aluminum particles have an average particle size of about 5 μm or smaller.

* * * * *